US005519179A

United States Patent [19]

Sato

[11] Patent Number: 5,519,179

[45] Date of Patent: May 21, 1996

[54] PRESSURE SWITCH

[75] Inventor: Kenichi Sato, Shimada, Japan

[73] Assignee: Yazaki Corporation, Tokyo, Japan

[21] Appl. No.: 359,428

[22] Filed: Dec. 20, 1994

[30] Foreign Application Priority Data

Jan. 20, 1994 [JP] Japan ..... 6-004415

[51] Int. Cl.[6] ..... H01H 35/34

[52] U.S. Cl. ..... 200/83 N; 73/723; 200/306

[58] Field of Search ..... 92/98 R; 340/611, 340/626; 307/118; 73/717, 723; 200/83 R, 83 A, 83 J, 83 N, 83 W, 51 R, 306

[56] References Cited

U.S. PATENT DOCUMENTS

| | | | |
|---|---|---|---|
| 3,600,535 | 8/1971 | Bergsma | 200/83 R |
| 4,521,651 | 6/1985 | Matsumoto | 200/83 R |
| 4,524,254 | 6/1985 | Yoshida | 200/83 R |
| 4,967,047 | 10/1990 | Betterton | 200/83 J |
| 4,978,821 | 12/1990 | Shon | 200/83 W |
| 5,216,213 | 6/1993 | Sato | 200/83 R |

FOREIGN PATENT DOCUMENTS

| | | | |
|---|---|---|---|
| 0016519 | 2/1980 | European Pat. Off. | 200/83 N |

*Primary Examiner*—Gerald P. Tolin

*Attorney, Agent, or Firm*—Armstrong, Westerman, Hattori, McLeland & Naughton

[57] ABSTRACT

This invention provides a pressure switch and a method of manufacture thereof, which allow the air vent hole to be formed very small in diameter so that the engine oil can be reliably prevented from flowing out through this air vent hole.

The reduced diameter portion of the air vent hole 13 is formed in the following steps during the process of resin-molding the insulating cap 3 of the pressure switch 1. After the air vent hole 13 having the outwardly projecting portion 14 is formed, the recessed portion 16 of the jig 17 is placed in contact with the circumferential surface of the projecting portion 14 of the air vent hole 13. The jig 17 is pressed against the projecting portion 14 of the air vent hole 13 with a specified pressure to deform the projecting portion 14 and thereby reduce the inner diameter of the air vent hole 13 at the end.

2 Claims, 2 Drawing Sheets

PRESSURE SWITCH

BACKGROUND OF THE INVENTION (1) Field of the Invention

The present invention relates to a pressure switch and a method of manufacture thereof and, more specifically, to a pressure switch which has a vent communicating the interior with the exterior of the switch and which has a means to effectively prevent an outflow of engine oil through the vent. The invention also relates to a method of manufacturing such a pressure switch.

(2) Description of the Prior Art

A type of pressure switch has often been used which, when a pressure in an engine reaches a set pressure, closes its contact to generate, for example, an engine control signal.

Such a conventional pressure switch comprises an electrically conductive body and an insulating cap, with a diaphragm which deforms according to pressure installed inside the conductive body.

When a pressure in the engine is not high enough to activate the diaphragm, the contact is on. As the engine pressure increases and the diaphragm is activated, the contact is turned off, issuing a signal indicating that the pressure has exceeded the set value.

This pressure switch also has a vent formed in the insulating cap that communicates the interior with the exterior of the switch to draw air into the switch in order to minimize possible changes in the activating point of the diaphragm that may be caused by temperature changes.

SUMMARY OF THE INVENTION

With the above-mentioned pressure switch, however, when the diaphragm or packing is damaged, an increase in the internal pressure of the engine may cause engine oil contained in the engine to flow out through the vent. For example, the inner diameter of the vent is usually around 0.8 mm. When the engine internal pressure reaches about 4 kg/cm2, it is expected that approximately 100 cc of engine oil will flow out through the vent.

A possible countermeasure may include reducing the internal diameter of the vent below 0.8 mm to reduce the amount of oil flowing out. The vent has conventionally been formed by using a pull pin during the resin molding process. If the pull pin diameter is set below 0.8 mm, however, the pull pin will be deformed by the pressure of the flowing resin during the molding process. For this reason, the 0.8-mm diameter is substantially a lower limit for the vent formed in the resin and it is not possible to properly form a vent smaller than 0.8 mm in diameter.

The present invention has been accomplished to overcome the above-mentioned drawback and its object is to provide a pressure switch and a method of manufacture thereof, which permit a very small vent to be formed therein so as to reliably prevent the outflow of the engine oil through the vent.

According to a first aspect of this invention, the pressure switch comprises:

an electrically conductive body;

an insulating cap;

a diaphragm clamped between the electrically conductive body and the insulating cap to form an open air chamber between the insulating cap and the diaphragm and a pressure chamber between the electrically conductive body and the diaphragm;

a stationary contact provided on the electrically conductive body side;

a movable contact provided on the diaphragm side, the movable contact coming into or out of contact with the stationary contact when a pressure in the pressure chamber reaches a predetermined value, thus detecting the pressure;

an air vent hole formed in a circumference of the insulating cap to communicate the open air chamber with the exterior of the switch; and an outwardly projecting portion formed at an outer end of the air vent hole;

wherein a cross sectional area of the air vent hole inside the projecting portion is locally reduced.

According to a second aspect of this invention, the locally reduced cross-sectional portion of the air vent hole is formed by compression.

According to a third aspect of this invention, the locally reduced cross-sectional portion of the air vent hole has an inner diameter of preferably less than 0.8 mm.

According to a fourth aspect of this invention, the pressure switch manufacturing method comprises the steps of:

forming an insulating cap by molding resin;

clamping a pressure detecting diaphragm between the insulating cap and an electrically conductive body to form an open air chamber between the insulating cap and the diaphragm and a pressure chamber between the electrically conductive body and the diaphragm; and during the process of resin-molding the insulating cap, forming an air vent hole having an outwardly projecting portion;

placing a jig against the projecting portion of the air vent hole; and pressing the jig against the projecting portion with a specified pressure to deform the projecting portion of the air vent hole to locally reduce the cross section of the air vent hole and thereby form a locally reduced cross-sectional portion.

According to a fifth aspect of this invention, the circumferential surface of the projecting portion is tapered down toward the end thereof, the jig is formed with a recessed portion that engages with the circumferential surface of the projecting portion, and the recessed portion of the jig is given an expanding taper.

According to a sixth aspect of this invention, the recessed portion of the jig is integrally formed with a pin of a desired diameter, the jig is engaged with the projecting portion so that the pin is inserted into the air vent hole, and then the jig is pressed against the projecting portion of the air vent hole to form a locally reduced cross-sectional portion in the air vent hole.

According to a seventh aspect of this invention, the jig is preferably provided with a heating means.

With the pressure switch and the method of manufacture thereof according to this invention, because the projecting portion of the air vent hole is compressed by the jig after the air vent hole is formed while molding the insulating cap, it is possible to make the diameter of the air vent hole locally as small as less than 0.8 mm, when compared with the conventional method in which case a pull pin is used to form the air vent hole during the resin molding process. The locally reduced cross-sectional portion of the air vent hole ensures that the engine oil will not flow out of the air vent hole even when the internal pressure of the engine increases.

This in turn reliably prevents engine troubles, such as seizure, that may be caused by the outflow of engine oil.

DETAILED DESCRIPTION OF PREFERRED EMBODIMENT

Embodiments of this invention will be described by referring to the accompanying drawings.

Figure 1:
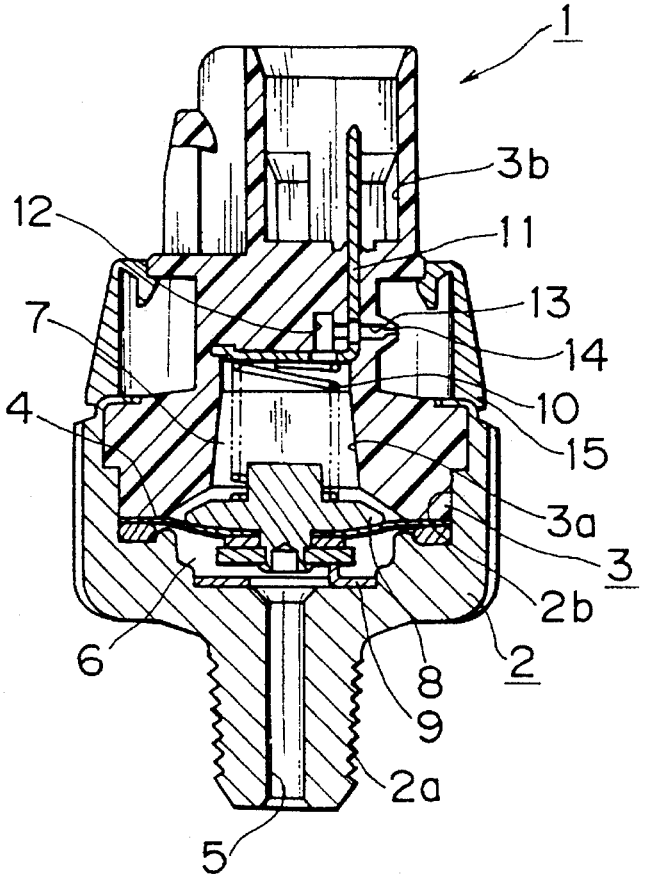
FIG. 1 is a vertical cross section of one embodiment of the pressure switch according to this invention.

FIG. 1 shows one embodiment of the pressure switch according to this invent ion. In this embodiment, the pressure switch 1 comprises a metallic conductive body 2 having a threaded portion 2*a* to be screwed into the engine at a predetermined position; and an insulating cap 3 that is fixed to the conductive body 2 as one piece by fitting the cap in a recess 2*b* of the conductive body 2 and bending an open edge portion of the conductive body 2 inwardly. The insulating cap 3 has a recess 3*a* therein. A diaphragm 4 of elastic material is clamped at its peripheral portion between the conductive body 2 and the insulating cap 3. The diaphragm 4 and the recess 2*b* of the conductive body 2 forms a pressure chamber 6 that communicates through a communicating hole 5 to a specified pressure portion, such as an engine. The diaphragm 4 also forms, together with the recess 3*a* of the insulating cap 3, an open air chamber 7.

A center disk 8, that functions as a movable contact exposed on the side of the open air chamber 7, is fixed to the center of the diaphragm 4 so that it can engage with, and part from, a conductive plate 9 that functions as a fixed contact installed on the side of the pressure chamber 6. The diaphragm 4 fixedly attached with the center disk 8 is urged toward the pressure chamber 6 by a coil spring 10 installed inside the recess 3*a* of the insulating cap 3. At the upper part of the insulating cap 3, an external output terminal 11, L-shaped in cross section, which is connected to the upper end of the coil spring 10 and pierces upwardly through the insulating cap 3, partly protrudes outside and, together with a connector housing 3*b* formed integral with the insulating cap 3, constitutes a female connector for electrical connection with an engine control circuit not shown.

In this embodiment, at the top portion of the recess 3*a* of the insulating cap 3 is formed an air vent groove 12, which is formed with a small-diameter air vent hole 13 that passes through the insulating cap 3 to communicate with the open air. Further, the air vent hole 13 has a projecting portion 14 that protrudes outwardly of the insulating cap 3. The outer circumferential surface of the projecting portion 14 is tapered down toward its end as shown at 14*a* so that the end of the projecting portion 14 is smaller in diameter. The outer circumference of that portion of the insulating cap 3 formed with the air vent hole 13 is mounted with a water-proof cover 15.

Next, how the air vent hole 13 is formed in this embodiment will be explained by referring to FIG. 2 to 4.

Figure 2:
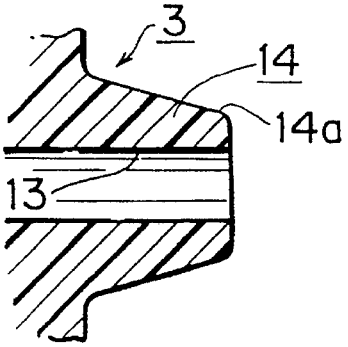
FIG. 2 is an enlarged cross section of a vent in the pressure switch of this invention.

In this embodiment, as shown in FIG. 2, the insulating cap 3 is formed, during the resin molding, with the projecting portion 14 having the tapered circumference 14*a* and also with the air vent hole 13 about 0.8 mm in inner diameter.

Figure 3:
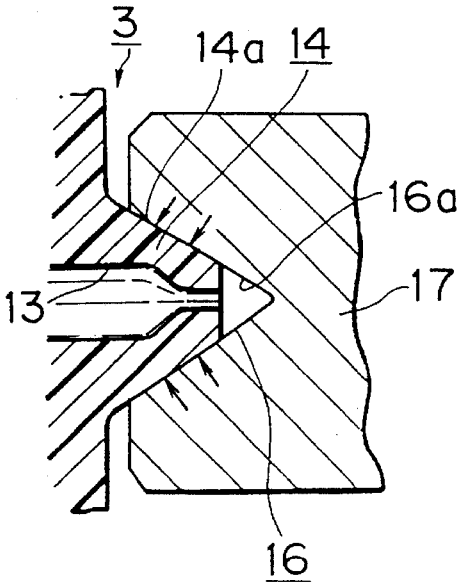
FIG. 3 is a schematic cross section showing one embodiment of the method of manufacturing the pressure switch of this invention.

Then, as shown in FIG. 3, a jig 17 is used to reduce the inner diameter of the end portion of the air vent hole 13. The jig 17 has a recessed press portion 16 that is formed with an expanding taper 16*a*, whose taper angle is smaller than that of the tapered circumference 14*a* and which engages with the tapered circumference 14*a* of the projecting portion 14 of the air vent hole 13. With the recessed press portion 16 of the jig 17 engaged with the projecting portion 14 of the air vent hole 13, the jig 17 is pushed with a predetermined force to deform the projecting portion 14 thereby locally reducing the cross sectional area of the air vent hole 13, i.e., the inner diameter at the end.

The deformation work using the jig 17 is preferably done while heat from the resin molding process remains. If the jig 17 is heated as by heater, the deformation of the projecting portion 14 is further facilitated.

Figure 4:
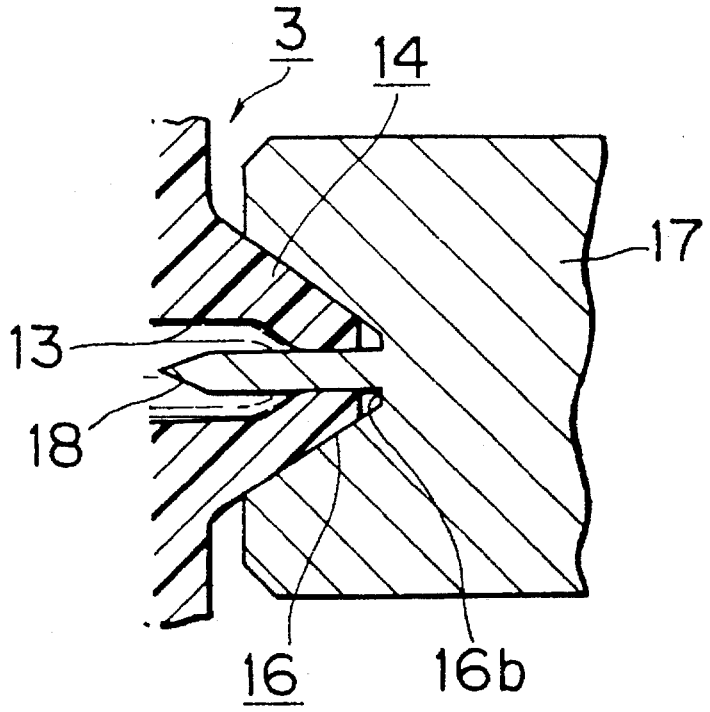
FIG. 4 is a schematic cross section showing another embodiment of the method of manufacturing the pressure switch of this invention.

Another method of forming the air vent hole 13 may involve, as shown in FIG. 4, forming a pin 18 of a desired diameter integral with and projecting from the bottom 16*b* of the recessed press portion 16, inserting the pin 18 into the air vent hole 13, and pressing the jig 17 against the projecting portion 14 of the air vent hole 13 to reduce the inner diameter of the end portion of the air vent hole 13, as in the case of the embodiment shown in FIG. 3. In this embodiment, the pin 18 integrally formed with the jig 17 makes it easy to form a desired inner diameter of the air vent hole 13, improving the dimensional accuracy.

Next, the working of this embodiment will be described.

In this embodiment, when a pressure in the pressure chamber 6 is not high enough to activate the diaphragm 4 against the force of the coil spring 10, the movable contact of the center disk 8 and the fixed contact of the conductive plate 9 are in contact with each other, turning on the switch, which is comprised of these contacts. In this condition, a circuit to the body earth via the external output terminal 11, coil spring 10, center disk 8, conductive plate 9 and conductive body 2 is complete.

When the pressure becomes high enough to activate the diaphragm 4 toward the open air chamber 7 against the force of the coil spring 10, the movable contact of the center disk 8 moves together with the-diaphragm 4, parting from the stationary contact of the conductive plate 9, turning off the switch to open the earthing circuit, which indicates that the pressure has exceeded a predetermined value.

In this embodiment, because the projecting portion 14 of the air vent hole 13 is compressed by the jig 17 after the air vent hole 13 is formed while molding the insulating cap 3, it is possible to make the diameter of the air vent hole 13 locally as small as less than 0.8 mm, when compared with the conventional method in which case a pull pin is used to form the air vent hole 13 during the resin molding process.

Figure 5:
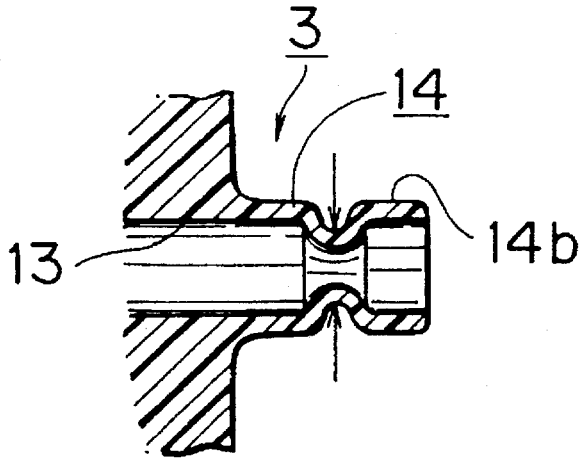
FIG. 5 is a schematic cross section showing still another embodiment of the method of manufacturing the pressure switch of this invention.

FIG. 5 shows another embodiment of this invention. In this embodiment, the projecting portion 14 of the air vent hole 13 formed in the insulating cap 3 of the pressure switch 1 is formed as a cylindrical portion 14*b*. The intermediate part of the cylindrical portion 14*b* is compressed from the outer circumference by a jig not shown to reduce the cross sectional area or inner diameter of the intermediate portion of the air vent hole 13. With this embodiment also, the air vent hole 13 can be locally reduced to a very small inner diameter.

The invention is not limited to these embodiments and various modifications may be made as required. Although in the above embodiment the cross sectional area of the air vent hole 13 is locally reduced to form a small inner-diameter portion by the compressing force of the jig 17 acting from the outer circumference of the projecting portion 14, it is possible to form a partly reduced cross section by applying a compressing force to the projecting portion 14 only from the top and bottom.

As described above, because the pressure switch of this invention and the method of manufacture thereof permit the inner diameter of the air vent hole in the insulating cap to be formed very small, when the engine's internal pressure increases, the engine oil can be reliably prevented from flowing out through the air vent hole, which in turn will prevent engine troubles such as seizure that may be caused by the outflow of engine oil.

What is claimed is:

1. A pressure switch comprising:

an electrically conductive body;

an insulating cap;

a diaphragm clamped between the electrically conductive body and the insulating cap to form an open air chamber between the insulating cap and the diaphragm and a pressure chamber between the electrically conductive body and the diaphragm;

a stationary contact provided on the electrically conductive body adjacent one side of said diaphragm;

a movable contact provided on the diaphragm on the side thereof adjacent said stationary contact, the movable contact coming into or out of contact with the stationary contact when a pressure in the pressure chamber reaches a predetermined value, thus detecting the pressure;

an air vent hole formed in a wall of the insulating cap to communicate the open air chamber with the exterior of the switch; and an outwardly projecting portion formed at an outer end of the air vent hole;

said air vent hole within said projecting portion having a cross sectional flow area which is locally reduced to a diameter that limits the passage of pressurized oil but not the passage of air, wherein said air vent hold through said wall of said insulating cap has a substantially constant diameter length which extends axially into said outwardly projecting portion, and said air vent hole in said outwardly projecting portion contains a radial constriction smaller than said diameter defining said locally reduced diameter.

2. A pressure switch according to claim 1, wherein the locally reduced cross-sectional portion of the air vent hole has an inner diameter of less than 0.8 mm.

* * * * *